US009513022B2

(12) United States Patent
Zhong et al.

(10) Patent No.: US 9,513,022 B2
(45) Date of Patent: Dec. 6, 2016

(54) VENTILATING FAN

(71) Applicants: Panasonic Ecology Systems Guangdong Co., Ltd., Foshan, Guangdong (CN); Panasonic Corporation, Osaka (JP)

(72) Inventors: Bodong Zhong, Guangdong (CN); Min Long, Guangdong (CN); Jiahan Hong, Guangdong (CN); Shi Zhen, Guangdong (CN); Shouyong Gao, Guangdong (CN); Norihiko Hasegawa, Aichi (JP)

(73) Assignees: Panasonic Ecology Systems Guangdong Co., Ltd., Guangdong (CN); Panasonic Corporation, Osaka (JP)

( * ) Notice: Subject to any disclaimer, the term of this patent is extended or adjusted under 35 U.S.C. 154(b) by 522 days.

(21) Appl. No.: 13/683,035

(22) Filed: Nov. 21, 2012

(65) Prior Publication Data

US 2013/0137360 A1 May 30, 2013

(30) Foreign Application Priority Data

Nov. 28, 2011 (CN) ..... 2011 2 0484354 U

(51) Int. Cl.

| | |
|---|---|
| ***F24F 7/06*** | (2006.01) |
| ***F24F 7/00*** | (2006.01) |
| ***F24F 13/00*** | (2006.01) |
| ***F24F 7/013*** | (2006.01) |
| ***F24F 13/02*** | (2006.01) |

(52) U.S. Cl.
CPC ..... *F24F 7/00* (2013.01); *F24F 7/013* (2013.01); *F24F 13/0209* (2013.01)

(58) Field of Classification Search
CPC .... F24F 13/0209; F16L 37/008; F16L 37/252; F16L 37/0985
USPC ..... 454/341, 366, 354, 339, 1, 14, 47, 242,454/248, 253
See application file for complete search history.

(56) References Cited

U.S. PATENT DOCUMENTS 2,918,053 A * 12/1959 Epstein ..... F16L 37/0985 126/307 R
3,596,936 A * 8/1971 Dieckmann et al. ..... 285/222.1

* cited by examiner

*Primary Examiner* — Avinash Savani
*Assistant Examiner* — Vivek Shirsat
(74) *Attorney, Agent, or Firm* — RatnerPrestia

(57) ABSTRACT

The present invention discloses a ventilating fan including a ventilating fan body located on the indoor side, an outdoor pipe hood located on the outdoor side, a ventilating fan mounting member located between the ventilating fan body and the outdoor pipe hood, and a panel removably mounted to the front of the ventilating fan body, the ventilating fan mounting member includes a cylinder and a flange, the outdoor pipe hood includes a pipe hood base and a back cover, the pipe hood base includes a base plate with a circular opening and a pipeline fixing ring removably mounted to the base plate; and, a hollow expansion pipe being connected to the cylinder of the ventilating fan mounting member at one end and connected to the pipeline fixing ring at the other end. The present invention has advantages of easy mounting of the expansion pipe.

7 Claims, 6 Drawing Sheets

VENTILATING FAN

CROSS-REFERENCE TO RELATED APPLICATION

This application claims the benefit of Chinese Patent Application No. 201120484354.X filed on Nov. 28, 2011 in the State Intellectual Property Office of China, the disclosure of which is incorporated herein by reference.

BACKGROUND OF THE INVENTION

Field of the Invention

The present invention relates to a ventilating fan, particularly, a ventilating fan with a sleeve or air discharge pipe communicated to outdoor side, configured to discharge indoor air to outdoor and/or suck air from the outdoor side to the indoor side so as to exchange air in a room.

Description of the Related Art

As shown in FIG. 1, a conventional ventilating fan 101 is provided, which includes a ventilating fan body 2 located on the indoor side 1, an outdoor pipe hood 4 located on the outdoor side 3, a ventilating fan mounting member 5 located between the ventilating fan body 2 and the outdoor pipe hood 4, and a panel 6 removably mounted to the ventilating fan body 2. The outdoor pipe hood 4 comprises a pipe hood base 7 and a back cover 8 welded together, wherein the pipe hood base 7 is integrally formed with a pipeline fixing ring 9.

As shown in FIG. 1, in order to mount the ventilating fan body 2, an indoor wall opening portion 11 in the indoor wall facing to the indoor side 1 of a room and an outdoor wall opening portion 31 in the outdoor wall facing to the outdoor side 3 of a room are provided. The indoor wall opening portion 11 and the outdoor wall opening portion 31 are formed to face with each other and an interpenetration portion 10 is provided therebetween. The ventilating fan mounting member 5 comprises a cylinder 51 and a flange (not shown), and is mounted passing through the indoor wall along the direction from the indoor side 1 towards the interpenetration portion 10. A pipeline fixing ring 9 of the pipe hood base 7 is engaged to a cylinder 51 of the ventilating fan mounting member 5 while mounting the outdoor pipe hood 4 onto the outdoor wall along the direction from the outdoor side 3 towards the interpenetration portion 10.

With regard to a ventilating fan in the prior art, the cylinder 51 of the ventilating fan mounting member 5 can be directly connected to the pipeline fixing ring 9 of the pipe hood base 7 as the distant between the indoor wall and the outdoor wall is small, i.e., the interpenetration 10 has a short length, thereby achieving an easy and reliable mounting.

However, when the distant between the indoor wall and the outdoor wall is relatively big, the cylinder 51 of the ventilating fan mounting member 5 cannot be directly connected to the pipeline fixing ring 9 of the pipe hood base 7. Instead, an expansion pipe 20 is needed to connect them together.

When an expansion pipe 20 is used, it would be shifted due to the vibration during the operation of the ventilating fan body 2. Thus, the connections between the expansion pipe 20 and the cylinder 51 and the pipeline fixing ring 9 have to be adhered by an adhesive tape to ensure a stable connection. However, due to a narrow gap between the pipe hood base 7 and the pipeline fixing ring 9, it is difficult to perform tape adhering.

Further, as it is needed to firstly fix and adhere the expansion pipe 20 to the pipeline fixing ring 9 and then fix the pipe hood base 7 on the outdoor wall, the adhering operation of tape should be performed after aligning the mounting orientation of the pipe hood base 7 to its mounting position because the pipeline fixing ring 9 would not be rotated after being adhered and fixed to the expansion pipe 20. This process is troublesome and causes inconvenience.

SUMMARY OF THE INVENTION

The present invention has been made to overcome or alleviate at least one of the above-mentioned problems and drawbacks existing in the prior art.

Accordingly, it is at least an object of the present invention to provide a ventilating fan, which has a pipe hood structure for easy mounting of the expansion pipe.

In order to achieve at least one of the above-mentioned objects, the present invention provides a ventilating fan comprising a ventilating fan body located on the indoor side, an outdoor pipe hood located on the outdoor side, a ventilating fan mounting member located between the ventilating fan body and the outdoor pipe hood, and a panel removably mounted to the front of the ventilating fan body, the ventilating fan mounting member comprises a cylinder and a flange, and the outdoor pipe hood comprises a pipe hood base and a back cover, the pipe hood base comprises a base plate with a circular opening and a pipeline fixing ring removably mounted to the base plate; a hollow expansion pipe being connected to the cylinder of the ventilating fan mounting member by one end and connected to the pipeline fixing ring by the other end.

The pipeline fixing ring comprises a connection portion connected to the expansion pipe and a latch portion engaged to the base plate, the connection portion being provided with a section gap.

The latch portion of the pipeline fixing ring is provided with a concentric circular ring having a diameter bigger than that of the connection portion of the pipeline fixing ring, the peripheral edge of the circular ring being provided with a folded edge extending towards the connection portion, thereby forming a hollow circular ring between the folded edge and the connection portion; a protrusive circular ring extending towards the latch portion of the pipeline fixing ring is provided on the peripheral edge of the circular opening of the base plate, the hollow circular ring encircling the protrusive circular ring of the circular opening of the base plate.

An elastic plate bayonet catch is provided at the edge of circular opening of the base plate and engaged to the latch portion.

The elastic plate bayonet catch is provided with a hook portion and the latch portion is provided with an annular section gap on the outer side, which is engaged to said hook portion, wherein the pipeline fixing ring is rotatable along the hook portion.

The elastic plate bayonet catch is provided with reinforced ribs on the opposite outer sides with a height lower than that of the elastic plate bayonet catch.

One of the elastic plate bayonet catches is formed by a material with lower elasticity.

As apparent form the above, the ventilating fan according to the present invention at least has advantages of easy mounting of the expansion pipe.

BRIEF DESCRIPTION OF THE DRAWINGS

The present invention may be understood and its features made apparent to those skilled in the art by referencing the accompanying drawings.

DETAILED DESCRIPTION OF PREFERRED EMBODIMENTS OF THE INVENTION

Figure 2:
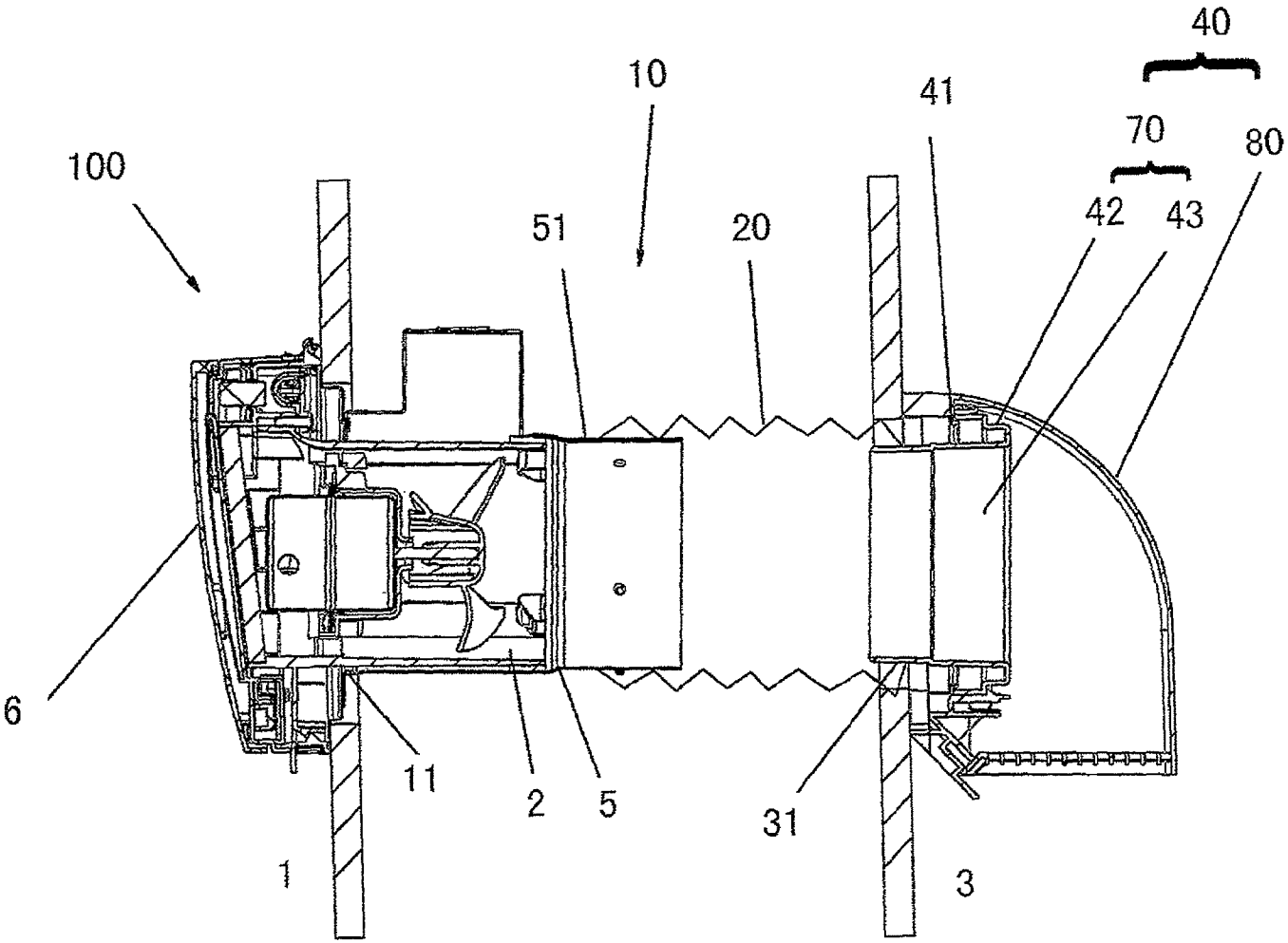
FIG. 2 is a structural cross section view in whole of the ventilating fan according to the present invention.

FIG. 2 is a structural cross section view in whole of the ventilating fan according to the present invention. As shown in FIG. 2, a ventilating fan 100 comprises a ventilating fan body 2 located on the indoor side 1, an outdoor pipe hood 40 located on the outdoor side 3, a ventilating fan mounting member 5 located between the ventilating fan body 2 and the outdoor pipe hood 40, and a panel 6 removably mounted to the front of the ventilating fan body 2. The ventilating fan mounting member 5 comprises a cylinder 51 and a flange (not shown). The outdoor pipe hood 40 comprises a pipe hood base 70 and a back cover 80, in which the pipe hood base 70 is formed by a base plate 42 with a circular opening 41 (also shown in FIG. 5) and a pipeline fixing ring 43 removably mounted to the base plate 42. A hollow expansion pipe 20 is connected to the cylinder 51 of the ventilating fan mounting member 5 at one end and connected to the pipeline fixing ring 43 at the other end.

With the above structure, the pipeline fixing ring 43 may be removed from the base plate 42.

In case the distant between the indoor wall and the outdoor wall is relatively big, the cylinder 51 of the ventilating fan mounting member 5 is connected to the pipeline fixing ring 43 of the pipe hood base 40 through the expansion pipe 20. Specifically, one end of the expansion pipe 20 is firstly connected to the cylinder 51 of the ventilating fan mounting member 5. As the cylinder 51 has a certain length, it is convenient to apply a tape at the connection.

Subsequently, after the end of the expansion pipe 20 is fixed to the cylinder 51 of the ventilating fan mounting member 5, the other end of the expansion pipe 20 is inserted into an indoor wall opening portion 11 from the indoor side towards interpenetration 10, passed through interpenetration 10 and protruded out of the outdoor wall opening portion 31, where a flange of the ventilating fan mounting member 5 is fixed on the indoor wall and the base plate 42 is fixed on the outdoor wall.

Then, the other end of the expansion pipe 20 is projected from the outdoor wall opening portion 31, passed through a circular opening 41 in the base plate 42 and connected to the pipeline fixing ring 43, where there is sufficient space at the connection of the expansion pipe 20 to the pipeline fixing ring 43 to be convenient for application of an adhesive tape. After the tape is applied to the connection, the pipeline fixing ring 43 is mounted to the base plate 42 on the outdoor side, finishing the mounting of the expansion pipe 20. At this point, as the base plate 42 is firstly mounted and fixed and subsequently the pipeline fixing ring 43 is mounted and fixed on the base plate 42 on the outdoor side, the mounting of the ventilating fan is greatly facilitated.

Figure 3:
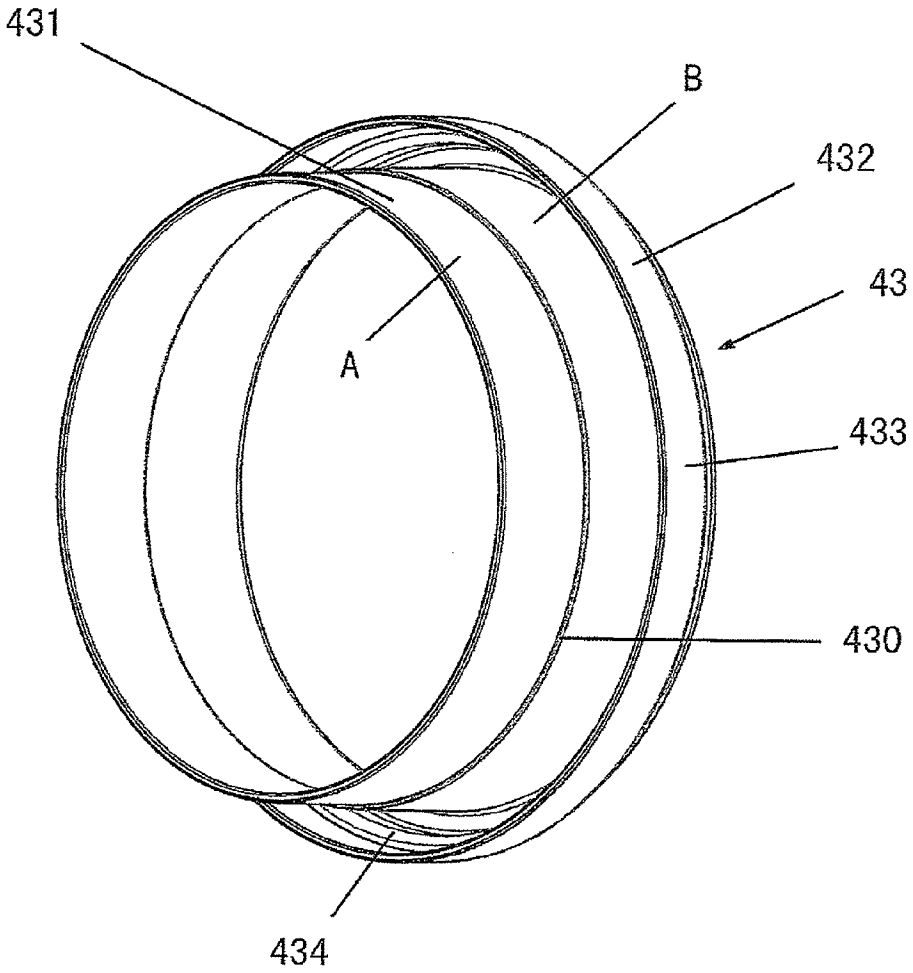
FIG. 3 is a schematic perspective view of a pipeline fixing ring according to the present invention.
Figure 4:
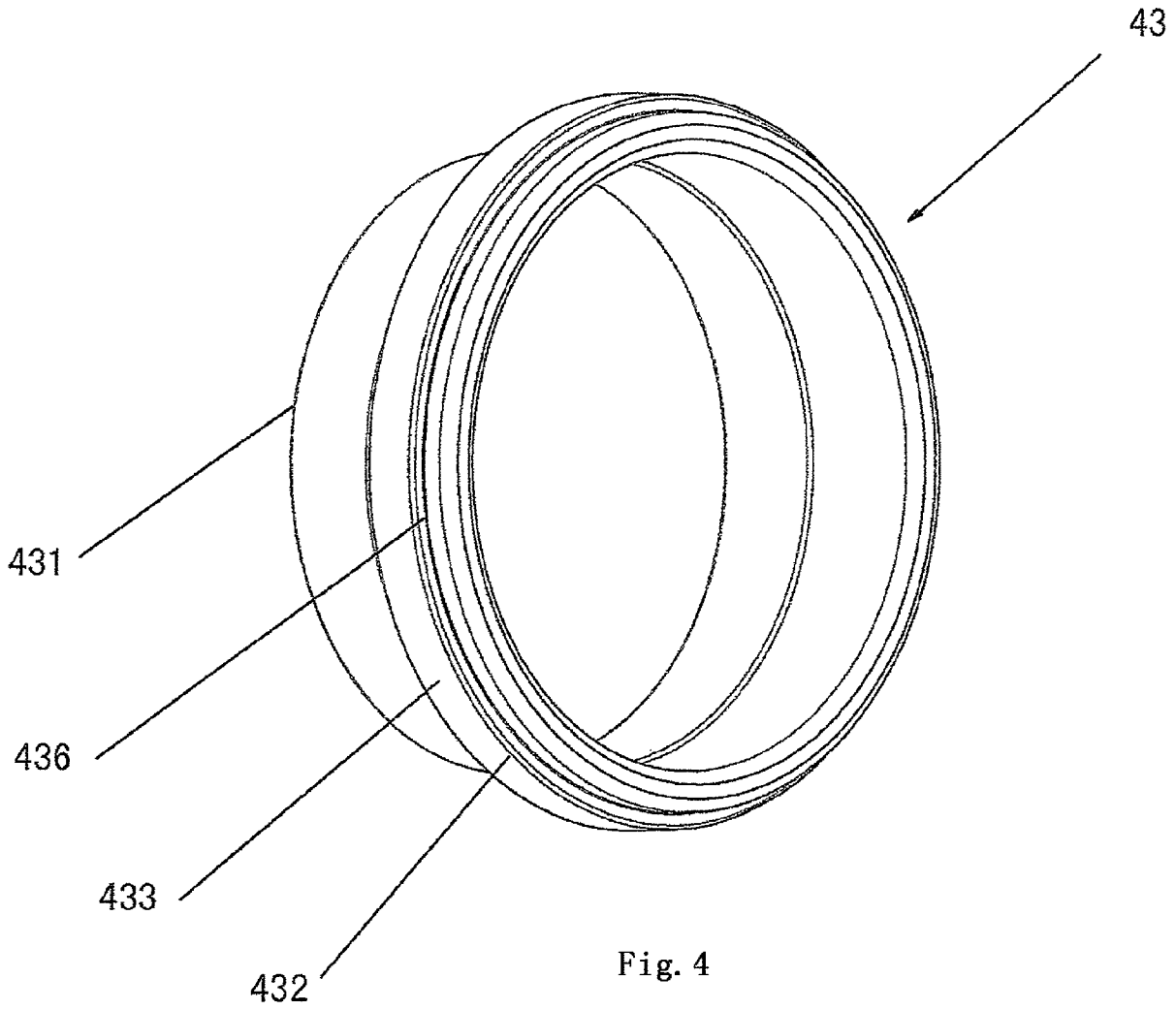
FIG. 4 is a another schematic perspective view of a pipeline fixing ring according to the present invention, viewed at another angle.
Figure 5:
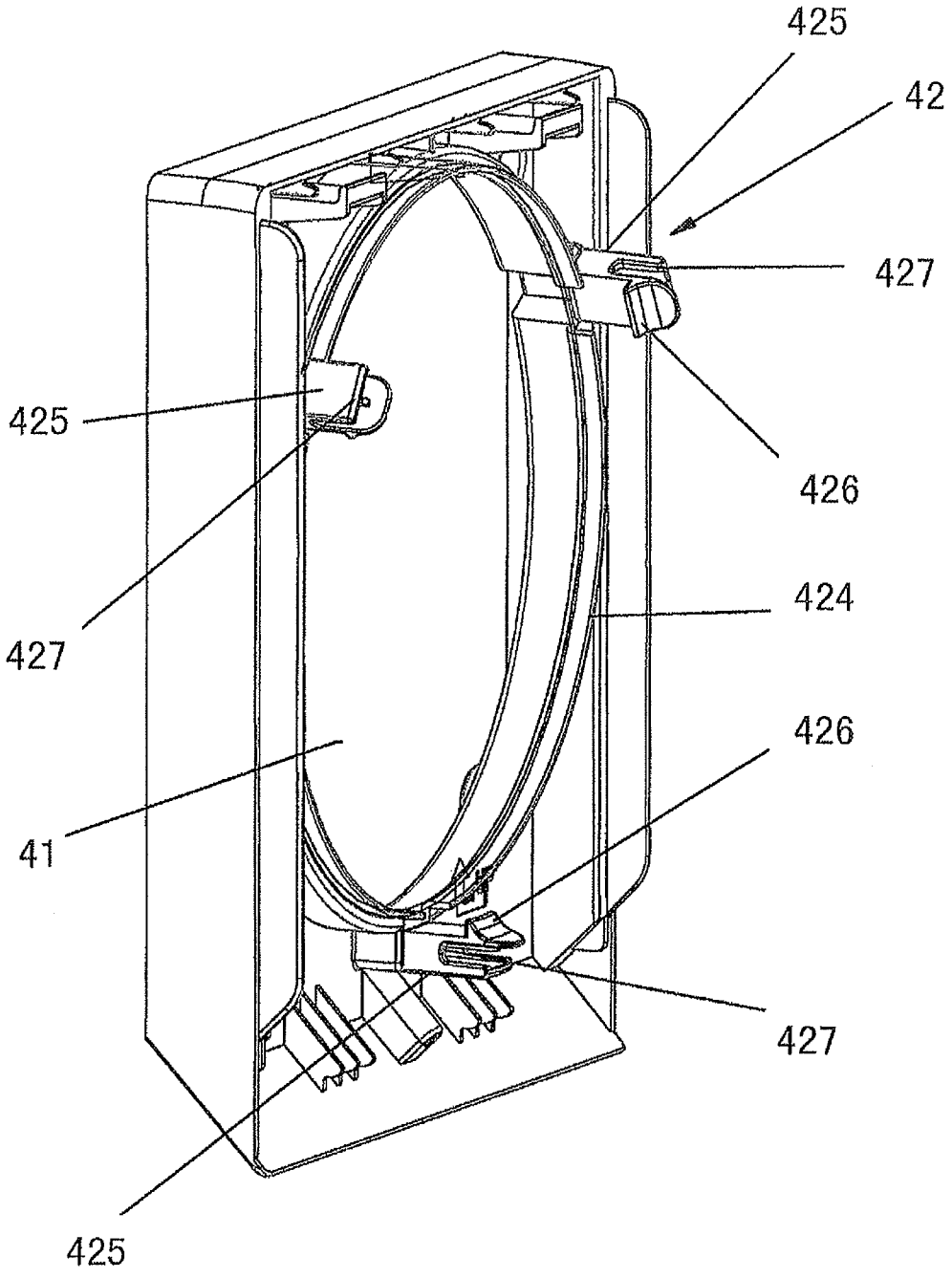
FIG. 5 is a schematic perspective view of a base plate according to the present invention.
Figure 6:
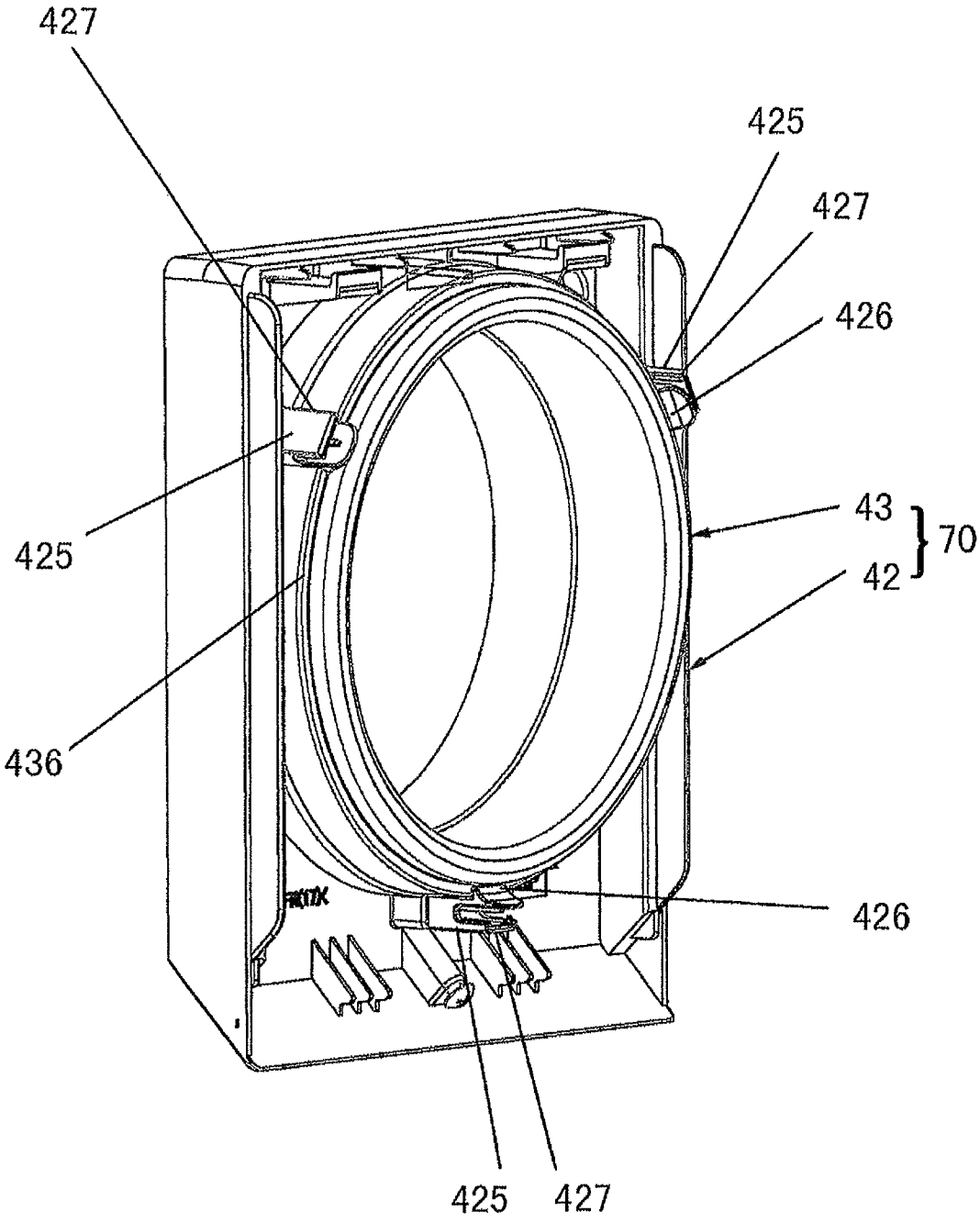
FIG. 6 is a schematic perspective view of the pipeline fixing ring mounted on the base plate according to the present invention.

FIGS. 3 and 4 are schematic perspective views of the pipeline fixing ring according to the present invention, viewed at two different angles. FIG. 5 is a schematic perspective view of the base plate according to the present invention. FIG. 6 is a schematic perspective view of the pipeline fixing ring mounted on the base plate according to the present invention.

Figure 1:
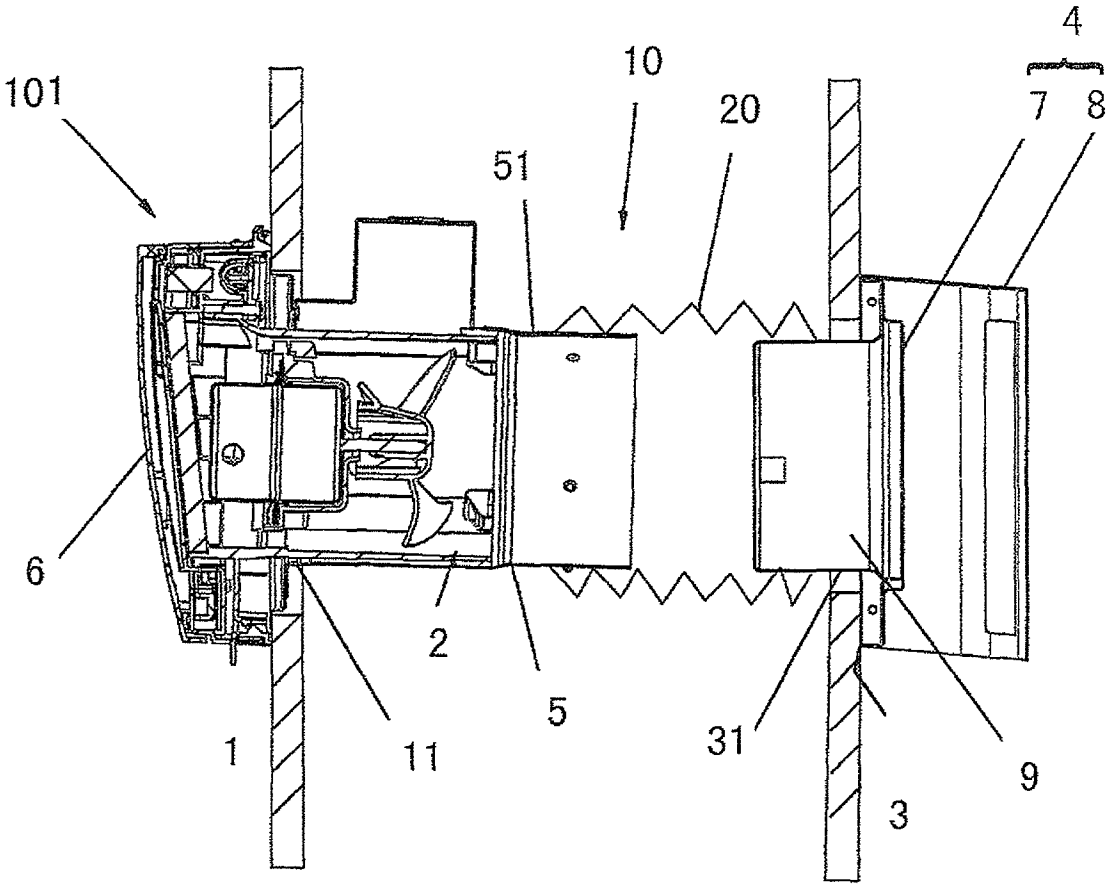
Fig. 1 Prior Art
FIG. 1 is a schematic view of a conventional ventilating fan in the prior art.

As shown, the pipeline fixing ring 43 comprises a connection portion 431 connected to the expansion pipe 20 (referring to FIGS. 1 and 2) and a latch portion 432 engaged to the base plate 42 (referring to FIG. 2). The connection portion 431 is provided with a section gap 430. The phase of "the connection portion 431 is provided with a section gap 430" means that the connection portion 431 comprises two concentric circular rings with different diameters, in which the diameter of the circular ring A on the side close to the expansion pipe 20 is smaller than that of the circular ring B on the side close to the latch portion, thereby the section gap between the circular ring A and the circular ring B is achieved. When the connection of the expansion pipe 20 is performed by the user by latching it to the connection portion 431, the section gap 430 may be used to prevent the expansion pipe 20 from extensively extending to the connection portion 431. That is, the section gap 430 may indicate a right position for introducing the expansion pipe 20 for the user, thereby facilitating the mounting process.

After the pipeline fixing ring 43 is mounted to the base plate 42 as shown, there may be a gap existing in the connection of the pipeline fixing ring 43 to the base plate 42, which leads to air leakage or water leakage. The latch portion 432 of the pipeline fixing ring 43 is provided with a concentric circular ring 433 having a diameter bigger than that of the connection portion 431 of the pipeline fixing ring 43. The peripheral edge of the concentric circular ring 433 is provided with a folded edge extending toward the connection portion 431, thereby a hollow circular ring 434 being formed between the folded edge and the connection portion 431. A protrusive circular ring 424 shown in FIG. 5 extending towards the latch portion 432 of the pipeline fixing ring 43 shown in FIG. 3 is provided on the peripheral edge of the circular opening 41 of the base plate 42, as shown in FIG. 5. After the pipeline fixing ring 43 shown in FIG. 3 is mounted to the base plate 42 shown in FIG. 5, the hollow circular ring 434 shown in FIG. 3 encircles the protrusive circular ring 424 of the circular opening 41 of the base plate 42 shown in FIG. 5, forming a structure of the pipeline fixing ring 43 shown in FIG. 3 completely joining the base plate 42 in FIG. 5 and preventing an air leakage and water leakage by contacting with the protrusive circular ring 424.

An elastic plate bayonet catch 425 is provided at the edge of circular opening 41 of the base plate 42 and engaged to the latch portion 432 shown in FIG. 4. The elastic plate bayonet catch 425 is provided with a hook portion 426 and the outer side of latch portion 432 is provided with an annular section gap 436, which is able to be engaged to the hook portion 426. The pipeline fixing ring 43 is able to be rotated along the hook portion 426. As the pipeline fixing ring 43 is still able to be rotated between the base plate 42 and the elastic plate bayonet catch 425 after having been mounted to the base plate 42 by means of the elastic plate bayonet catch 425, the orientation of the base plate 42 can still be adjusted so as to be horizontally mounted on the outdoor wall by rotating the pipeline fixing ring 43, even the expansion pipe 20 has been fixed to the pipeline fixing ring 43 by use of the tape.

The elastic plate bayonet catch 425 is provided with reinforced ribs 427 on the opposite outer sides with a height lower than that of the elastic plate bayonet catch 425. As it is provided on the outer side of the elastic plate bayonet catch 425 with a height lower than that of the elastic plate bayonet catch 425, the reinforced rib 427 does not obstruct or hinder user in pushing the elastic plate bayonet catches 425 apart from each other. Further, the elastic plate bayonet catches 425 will contact the reinforced rib 427 when they are excessively pushed towards outside, thereby preventing from pushing the elastic plate bayonet catch 425 apart from each other in excess to damage the bayonet catch, so as to improve durability of the elastic plate bayonet catch 425.

In addition, in an alternative embodiment, with other elastic plate bayonet catch 425, the pipeline fixing ring 43 can be more stably mounted on the base plate 42 by forming the lower side elastic plate bayonet catch 425 from material with a lower elasticity, i.e., material with a low flexibility, to firmly latch it to the latch portion 432 to some extent.

What is claimed is:

1. A ventilating fan, comprising:

a ventilating fan body located on the indoor side, an outdoor pipe hood located on the outdoor side, a ventilating fan mounting member located between the ventilating fan body and the outdoor pipe hood, and a panel removably mounted to a front of the ventilating fan body, the ventilating fan mounting member comprises a cylinder and a flange, and the outdoor pipe hood comprises a pipe hood base and a back cover, wherein, the pipe hood base comprises a base plate with a circular opening and a pipeline fixing ring removably mounted to the base plate, the pipeline fixing rind comprising a latch portion and a connection portion, the connection portion being connected to an expansion pipe and having a diameter smaller than that of the circular opening, the latch portion including a concentric circular ring having a diameter larger than that of the connection portion, a peripheral edge of the concentric circular ring having a folded edge extending toward the connection portion such that a hollow circular ring is formed between the folded edge and the connection portion;

wherein the pipe hood base being configured such that, after the base plate is mounted to an outdoor wall, one end of a hollow expansion pipe is passed through the circular opening of the base plate and connected to the connection portion of the pipeline fixing ring, and then the pipeline fixing ring is mounted to the base plate such that the hollow circular ring encircles a protrusive circular ring of the circular opening of the base plate;

the other end of the hollow expansion pipe is connected to the cylinder of the ventilating fan mounting member.

2. The ventilating fan according to claim 1, wherein the latch portion is engaged to the base plate, and the connection portion includes a section gap.

3. The ventilating fan according to claim 2, wherein the protrusive circular ring extends towards the latch portion of the pipeline fixing ring and is located on the peripheral edge of the circular opening of the base plate.

4. The ventilating fan according to claim 1, wherein an elastic plate bayonet catch is provided at the edge of circular opening of the base plate and engaged to the latch portion.

5. The ventilating fan according to claim 4, wherein the elastic plate bayonet catch is provided with a hook portion and the latch portion is provided with an annular section gap on the outer side, which is engaged to said hook portion, wherein the pipeline fixing ring is able to be rotated along the hook portion.

6. The ventilating fan according to claim 4, wherein the elastic plate bayonet catch is provided with reinforced ribs on opposite outer sides with a height lower than that of the elastic plate bayonet catch.

7. The ventilating fan according to claim 4, further comprising a plurality of elastic plate bayonet catches, wherein one of the elastic plate bayonet catches is formed by a material with a lower elasticity than the other elastic plate bayonet catches.

* * * * *